United States Patent [19]

Hanson

[11] 4,169,403

[45] Oct. 2, 1979

[54] BOMB CIRCUIT DISRUPTING DEVICE AND METHOD

[76] Inventor: Ralph W. Hanson, 6401 Goodrich Ave., St. Louis Park, Minn. 55426

[21] Appl. No.: 931,191

[22] Filed: Aug. 4, 1978

[51] Int. Cl.[2] ..... F42D 5/04

[52] U.S. Cl. ..... 86/1 B; 89/1 B; 102/1 R

[58] Field of Search ..... 102/92, 39, 92.1-92.7, 102/24 HC, 1; 89/1 B; 86/1 B; 42/1 R

[56] References Cited

U.S. PATENT DOCUMENTS

| | | | |
|---|---|---|---|
| 1,567,659 | 12/1925 | Laurence | 102/90 |
| 2,000,131 | 5/1935 | Goss | 102/65 |
| 3,117,518 | 1/1964 | Porter et al. | 86/1 B |
| 3,308,818 | 3/1967 | Rutkowski | 102/92 X |
| 3,724,372 | 4/1973 | Phillips | 86/1 A |
| 4,034,497 | 7/1977 | Yanda | 102/39 |
| 4,046,055 | 9/1977 | McDonalds | 86/1 B |

*Primary Examiner*—Harold J. Tudor
*Attorney, Agent, or Firm*—Leo Gregory

[57] ABSTRACT

This invention relates to a readily portable device to disrupt the bomb circuitry as of a home made bomb from a closely positioned point such as on the order of six to twelve inches and operated from a remote point. The device is a light weight tubular member having a barrel loaded with a liquid as a missile and the liquid is expelled by the expansion of gas from a fired cartridge, the gas follows the liquid directly. The liquid upon rupturing and entering the bomb housing disrupts the bomb circuitry and liquid coats the interior of the bomb housing to prevent a fire outbreak and the gas expanding with considerable force upon entering the bomb housing further disrupts the circuitry and other structure therein. The liquid attains a velocity on the order of 500 ft./sec. requiring about 500 microseconds to rupture and to enter the bomb housing and together with the accompanying expanding gas, disrupts the same. The element of time to accomplish this is less than the time required by a bomb circuit to be energized to detonate a bomb.

8 Claims, 7 Drawing Figures

FIG. 1
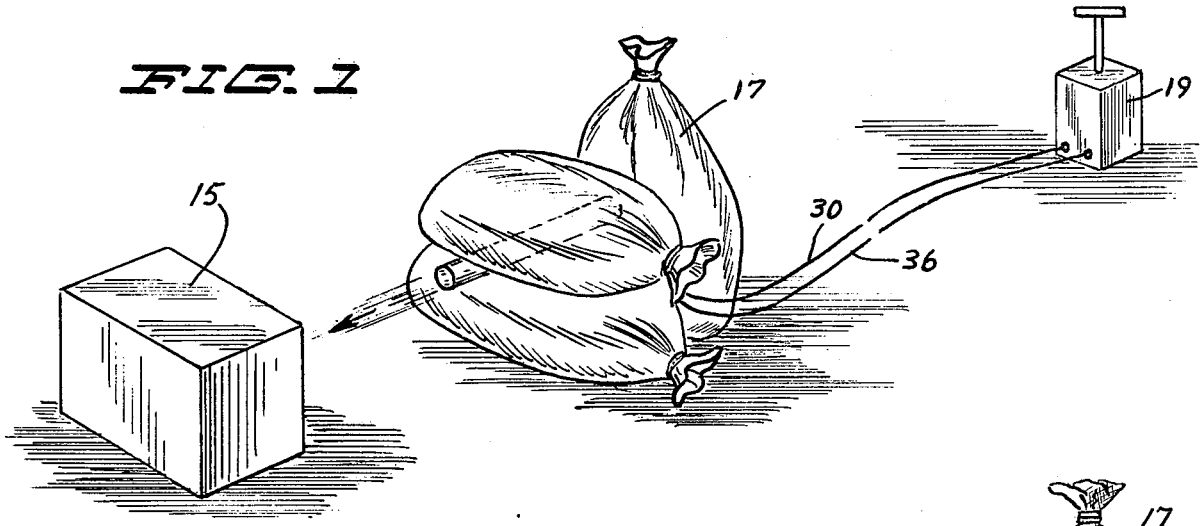
FIG. 2
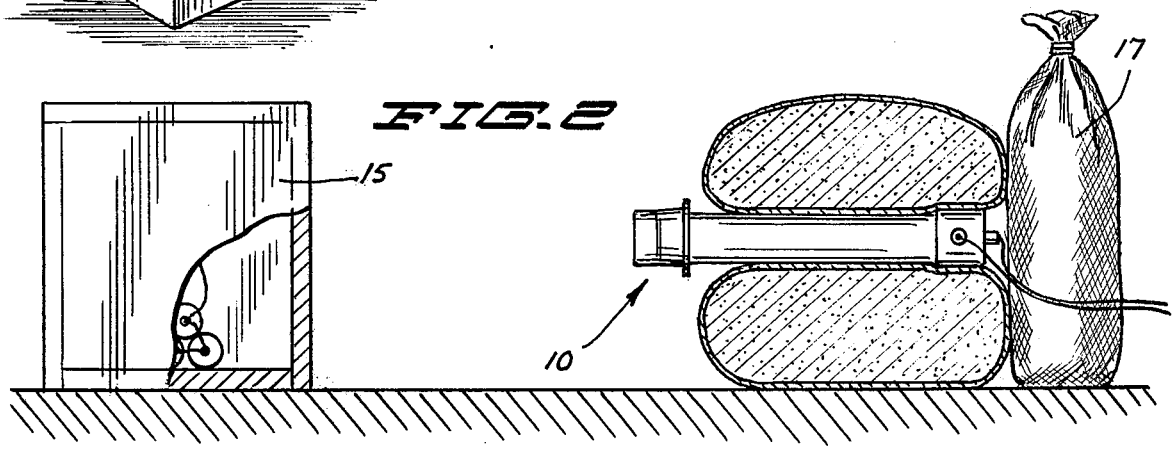
FIG. 3
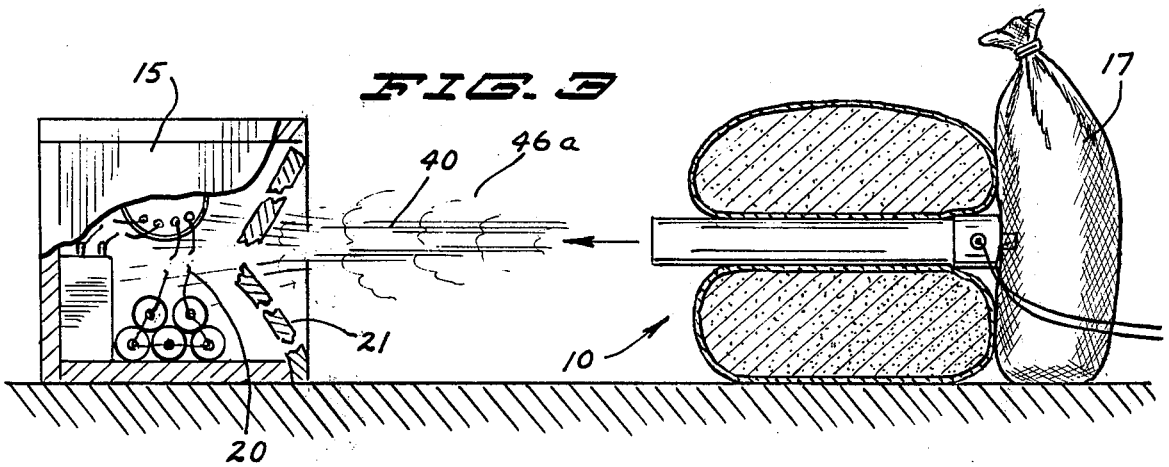
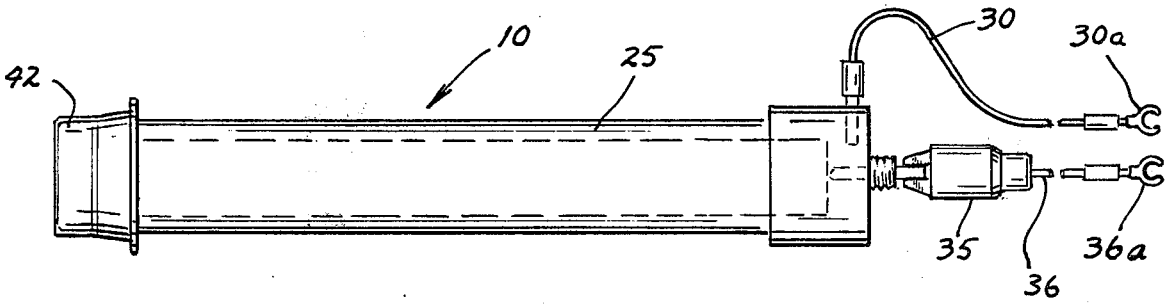
FIG. 4

BOMB CIRCUIT DISRUPTING DEVICE AND METHOD

BACKGROUND OF THE INVENTION

1. Field of the Invention

This invention relates to the field of bomb disrupting and deactivating devices.

2. Description of the Prior Art.

Art which is known includes U.S. Pat. No. 4,034,497 dated July 12, 1977 issued to Yanda consisting of a hand held self defense device which upon being triggered causes water to become heated and expelled by the gas generation of material within the water; U.S. Pat. No. 1,567,659 dated Dec. 29, 1925 to Lawrence comprises a hand held weapon which upon being fired causes a gas producing substance to vaporize and be discharged; U.S. Pat. No. 3,695,141 dated Oct. 3, 1972 to Kronman which provides the firing of a disc to disable the target device and U.S. Pat. No. 2,404,441 dated Feb. 7, 1942 to Hopkins which discloses a device to either insulate the context of a circuit to prevent detonation or to reduce the temperature of a bomb to the point at which it will be held inactive by freezing.

The device herein represents an improvement in a simplified structure using water as a missile together with a gas from a fired cartridge which expands with considerable force acting to propel the water as a missile and to act in concert therewith in following thereafter to enter the bomb housing and further disrupt the same, the water upon entering the bomb housing first wets the same to prevent a fire outbreak.

SUMMARY OF THE INVENTION

The invention herein comprising a simply constructed readily portable device comprising a tubular housing having a chamber to hold a liquid missile and having a cartridge therein which upon being fired provides an expanding gas to expel the missile under very high velocity and the expanding gas follows closely upon said missile to enter the bomb housing directly thereafter and further disrupting the contents of the bomb housing, the liquid missile entering said bomb housing first wets the same to prevent a fire outbreak with said device acting to disrupt the bomb in a time interval. Also, then would be required by the bomb detonating circuit to be energized and operative. It is one of the salient features of this device that in the detonation of the bomb no damage is caused by the device exterior of the bomb housing.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in perspective showing the device herein in operating position;

FIGS. 2 and 3 are views partially in vertical section showing the operation of the device herein;

FIG. 4 is a view of the device herein in side elevation;

DESCRIPTION OF A PREFERRED EMBODIMENT

Figure 5:
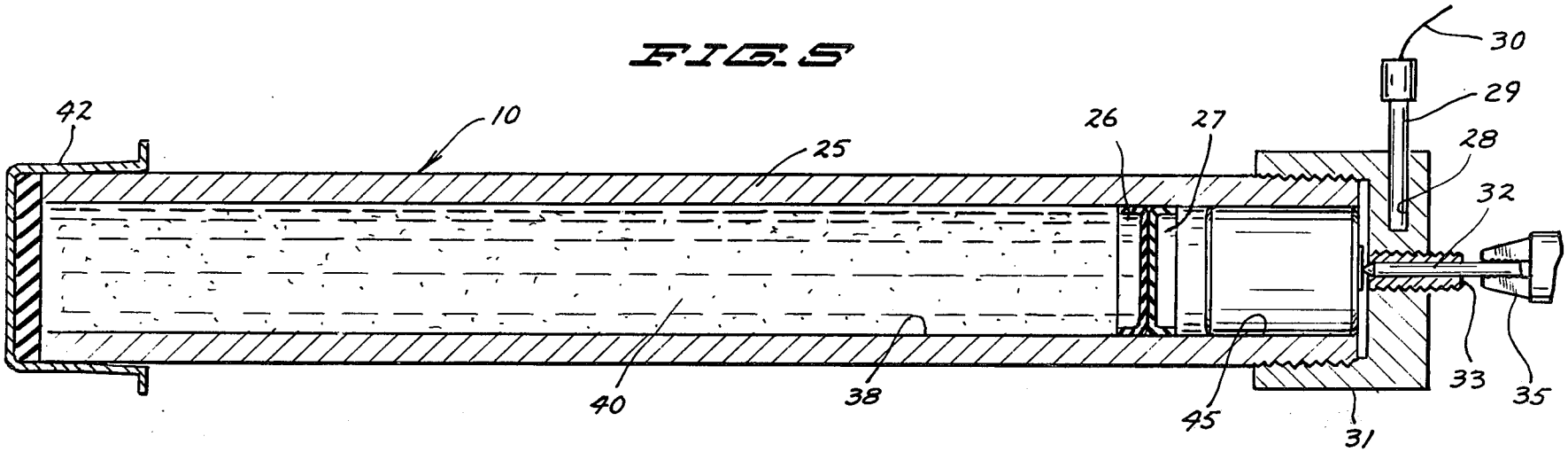
FIG. 5 is a view in vertical longitudinal section of the device herein on an enlarged scale.

Referring to the drawings, the invention herein comprising a bomb circuit disrupting device is indicated generally by the reference numeral 10.

In FIGS. 1–3, the device 10 is shown in operating position secured by sand bags 17 and having its electrical lines 30 and 36 running to an energy source 19 such as the detonating device illustrated and being aimed at a bomb 15. The forward wall 21 of said bomb is shown in ruptured condition and the circuitry 20 therein is disrupted resulting from the impact of and penetration by the liquid missile 40 followed closely by expanding gas **46*a*** as will be described. The use of sand bags for holding purposes is shown here for purpose of illustration and not for purpose of limitation.

Figure 7:
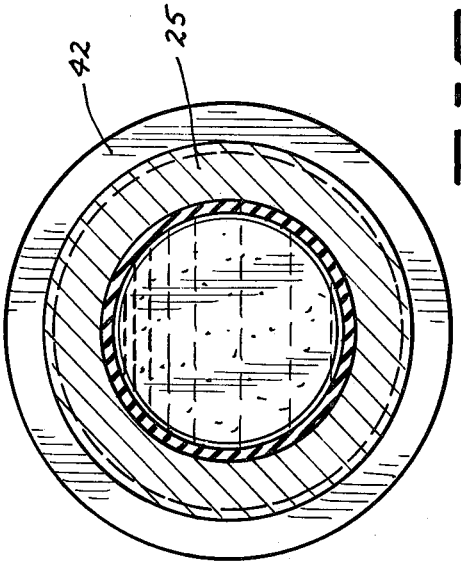
FIG. 7 is a view in transverse section taken on line 7–7 of FIG. 6 as indicated.
Figure 6:
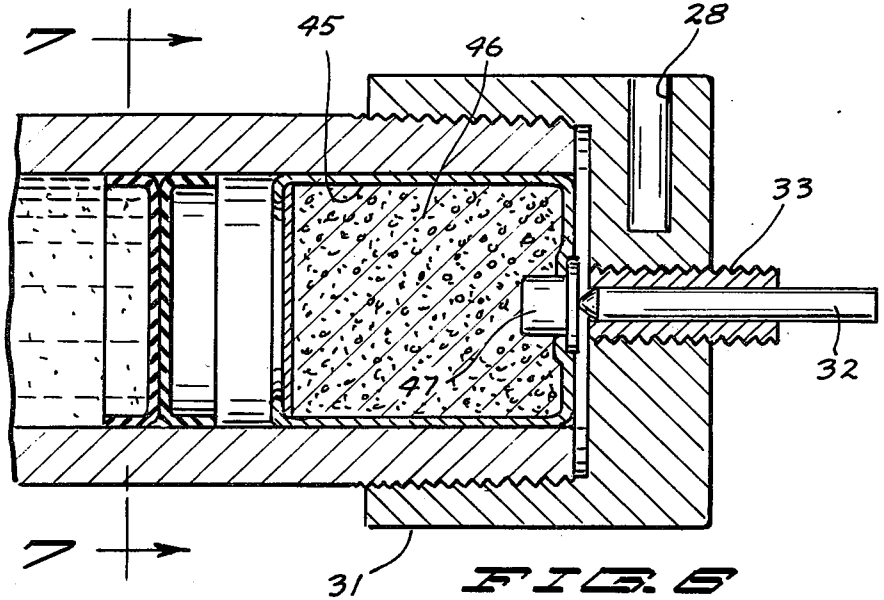
FIG. 6 is a fragmentary view of a detail of structure in vertical section in an enlarged scale.

Referring now to FIGS. 4–7, the device as here shown comprises a housing 25 of tubular form and this may be made very readily of conventional tubing material. For purpose of a practical illustration, said housing may be on the order of one and one-half inches O.D. and ten to twelve inches in length. With the use of aluminum tubing for the housing, the operating weight of the device is only on the order of one and one-half pounds.

Said housing is shown having a forward barrel or missile holding portion 38 forming a liquid holding missile chamber 40 therein and at the inner or rearward portion thereof is a releasable seal means 26 and is a like seal means 27 for a firing or cartridge chamber 45 which is shown having therein an expanding gas generating means shown here as a cartridge 46 and shown therewith is a firing cap 47. Said missile chamber has an unrestricted passage therethrough. For purposes herein, a loading of 6 grams of smokeless powder generates an expanding gas sufficient for operation of said device as herein described. Said seal means are of known structure.

A breech member 31 is threaded onto the rear end portion of said housing and threaded therein is an insulator 33 having an electrode 32 disposed therethrough for engagement with the firing cap 47 and carried on the outer projecting end of said electrode is a terminal or lead 35 having a wire or line 36 in circuit with said electrode and running to said energy source 19.

A transverse socket 28 in said breech 31 receives a jack or plug 29 of the ground wire or line 30 which is in circuit with said energy source 19. Said lines 30 and 36 are shown having attachment clips **30*a* and 36*a***.

Disposed in said chamber 38 is a liquid 40 and for purposes herein said chamber very suitably has a capacity on the order of 100 grams. Said liquid may very suitably be water or glycerine, by way of illustration.

Overlying the forward end of said housing and said missile chamber is a readily dislodged or releasable cap seal 42 which may be made suitably of a plastic material which is simply stretched tight or pressure fit over the end of said housing.

In FIG. 3, gases **46*a* from the fired cartridge 46 are shown expanding and passing through the shattered wall of said bomb 15** to further disrupt the circuitry therein.

Said gases upon expelling the water as a missile from the chamber 38 follow directly upon said water and with considerable expanding force enters the bomb housing ruptured by said water to further disrupt the circuitry therein, said liquid housing thoroughly wetted the interior of the housing to prevent any outbreak of fire.

OPERATION

In connection with a description of the operation of the above described device, the most general application for the device is with respect to a homemade type of bomb which for the most part has a container or housing a cardboard box, a wooden box, a suit case or an attache case or the like.

The device herein is positioned preferably within six to twelve inches of the bomb to be deactivated and may be secured in position as illustrated by the use of fifty or sixty pound sand bags. The device is readily accurately aimed at the bomb at such a short distance.

The cartridge will be fired from a safe point as by use of any convenient energy source such as a battery as other current supply. The use of liquid as a missile particularly in the form of water provides what is practically an expense free readily available missile having a very high degree of effectiveness.

The front seal 42 of the housing is a plastic cap or cover which is readily dislodged when the water is expelled by the firing of the cartridge 46.

The liquid 40 as a missile is judged to have a velocity on the order of 500 ft./sec. and at this velocity in tests made said liquid in the form of water has shattered a ⅝ inch pine board at a distance of 2 feet. This velocity is attained by the use of a cartridge having on the order of 6 grams of smokeless powder. At the velocity indicated, the increment of time for the liquid as a missile to penetrate and engage the circuitry within the bomb is on the order of 500 microseconds (0.0005 sec.). It is estimated that the explosion time of typical bomb detonators is on the order of 5 to 10 milliseconds (0.005 to 0.010 sec.) which is a substantially longer period of time than the penetration time to enter the housing and the time for disruption of the bomb by said liquid missile, there is an accompanying further disruption of said bomb by the considerable force of the expanding hot gases from the firing of the cartridge and these gases have substantial additional effect in disrupting the bomb circuitry.

When the cartridge 46 is fired, the seals 26 and 27 are expelled from the housing by the gases generated from the fired cartridge and serve to provide a wall between the gases and the liquid expelled. The seals in effect provide a solid front for the gases expelling the liquid.

One of the significant advantages of the device herein is the absence of damage being caused beyond the bomb housing. The liquid as a missile in effect spends itself in penetrating the bomb housing as do the gases following directly thereafter. This contrasts with the bomb deactivating devices which use a solid projectile or missile to penetrate the bomb housing and this type of projectile or missile has the capability of passing through the housing and of causing damage there beyond.

Among other salient features of the invention herein are its relatively small size making it very readily portable and easy to position as in confined areas. The use of a liquid as a missile which is readily available makes the device easy to load and avoids the need for carrying a supply of missiles. Sand bags are easily handled to position the device and it is understood that in the alternative an appropriate carriage may be provided.

The device has proved to be very successful in operation.

It will of course be understood that various changes may be in form, details, arrangement and proportions of the parts without departing from the scope of the invention herein which, generally stated, consists in an apparatus and method capable of carrying out the objects above set forth, in the parts and combinations of the parts disclosed and defined in the appended claims.

What is claimed is:

1. A device disrupting a bomb circuit within a bomb housing, having in combination an elongated housing having a missile chamber and a firing chamber therein, releasable seal means separating said chambers, said missile chamber having a discharge opening and an unrestricted passage through said missile chamber and said discharge opening, a releasable seal overlying said discharge opening, a liquid missile in said missile chamber, means in said firing chamber generating an expanding gas, said expanding gas expelling said missile rupturing and disrupting said bomb housing therewith in a faster period of time than that required for detonation of the bomb within said housing and wetting the interior of said bomb housing to prevent a fire outbreak, and said expanding gas following directly upon said missile entering and further disrupting the contents of said bomb housing.

2. The structure set forth in claim 1, wherein said housing is formed as a tubular member, having an unrestricted passage therethrough, said discharge opening is formed the full width of said passage, and said last mentioned seal is formed as a pressure fit cap member.

3. The structure set forth in claim 2, wherein said housing has an O.D. on the order of one and one half inches.

4. The structure set forth in claim 1, wherein said first mentioned releasable seal means comprises a pair of cup shaped seals in abutting oppositely facing relationship.

5. The structure set forth in claim 1, wherein said first mentioned means provide a front wall for said expanding gas.

6. The method for disrupting a bomb circuit within a bomb housing consisting of the steps of a. Disposing a non-combustible liquid into an elongated unrestricted chamber and forming a missile therewith, b. Removably sealing said liquid in said chamber, c. Providing an expanding gas generating means in a chamber adjacent said missile chamber, d. Separating said chambers by releasable means, e. Firing said gas generating means to expel said missile to rupture said bomb housing and disrupt the contents thereof at a speed greater than the time required for the detonation of the bomb, and f. Further disrupting the contents of said bomb housing by the passage of said gas into said bomb housing.

7. The steps set forth in claim 6, including the steps g. Providing said first mentioned chamber with on the order of 100 grams of said liquid, and h. Arranging said gas generating means to expel said liquid for penetration of said bomb housing at a velocity on the order of 500 ft./sec.

8. The steps set forth in claim 7, including the steps of i. Disposing said first mentioned chamber within six to twelve inches of a bomb housing.

* * * * *